US006854820B2

(12) United States Patent
Murakami et al.

(10) Patent No.: US 6,854,820 B2
(45) Date of Patent: Feb. 15, 2005

(54) METHOD FOR EJECTING LIQUID, LIQUID EJECTION HEAD AND IMAGE-FORMING APPARATUS USING THE SAME

(75) Inventors: Shuichi Murakami, Kanagawa (JP); Hiroshi Tajika, Kanagawa (JP); Michinari Mizutani, Kanagawa (JP); Norihiro Kawatoko, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 10/253,607

(22) Filed: Sep. 25, 2002

(65) Prior Publication Data

US 2003/0058305 A1 Mar. 27, 2003

(30) Foreign Application Priority Data

Sep. 26, 2001 (JP) ..... 2001-294663

(51) Int. Cl.[7] ..... B41J 29/38
(52) U.S. Cl. ..... 347/12
(58) Field of Search ..... 347/5, 9, 12, 13

(56) References Cited

U.S. PATENT DOCUMENTS

| | | | |
|---|---|---|---|
| 4,313,124 A | 1/1982 | Hara | |
| 4,345,262 A | 8/1982 | Shirato et al. | |
| 4,459,600 A | 7/1984 | Sato et al. | |
| 4,463,359 A | 7/1984 | Ayata et al. | |
| 4,558,333 A | 12/1985 | Sugitani et al. | |
| 4,608,577 A | 8/1986 | Hori | |
| 4,723,129 A | 2/1988 | Endo et al. | |
| 4,740,796 A | 4/1988 | Endo et al. | |
| 5,218,376 A | 6/1993 | Asai | |
| 5,565,899 A | 10/1996 | Sugimoto et al. | |
| 5,625,384 A | 4/1997 | Numata et al. | |
| 6,109,718 A | 8/2000 | Murakami et al. | |
| 6,123,411 A | 9/2000 | Inui et al. | |
| 6,155,666 A | 12/2000 | Sugimoto et al. | |
| 6,155,673 A | 12/2000 | Nakajima et al. | |
| 6,252,616 B1 | 6/2001 | Okazaki et al. | |
| 6,350,016 B1 | 2/2002 | Tachihara et al. | |
| 6,375,309 B1 | 4/2002 | Taneya et al. | |
| 6,428,144 B2 | 8/2002 | Mizutani | |
| 6,439,696 B1 | 8/2002 | Murakami et al. | |
| 6,443,561 B1 | 9/2002 | Murakami | |
| 2002/0036667 A1 * | 3/2002 | Shingyohuchi | 347/11 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 4-10940 | 1/1992 |
| JP | 4-10941 | 1/1992 |
| JP | 4-10942 | 1/1992 |

OTHER PUBLICATIONS

Reducing Drop Misregistration From Differential Aerodynamic Retardation In a Linear Ink Jet Array, Fisher, D.E., Sippel, D.I. IBM Technical Disclosure Bulletin, vol. 17, No. 10, Mar. 1975, pp. 3066–3067.*

* cited by examiner

*Primary Examiner*—Michael S. Brooke
(74) *Attorney, Agent, or Firm*—Fitzpatrick, Cella, Harper & Scinto

(57) ABSTRACT

In an liquid ejection head according to the present invention having a plurality of ejection openings arranged in a predetermined direction and a plurality of electro-thermal transducers for ejecting liquid from the ejection openings and being in relative motion with a printing medium, a kinetic energy of the liquid ejected from each ejection opening constituting an end group disposed in the respective opposite end section along the predetermined direction is larger than a kinetic energy of the liquid ejected from each ejection opening constituting a central group disposed in a central section along the predetermined direction. According to the present invention, it is possible to prevent an ink droplet ejected from the ejection opening in the end group from being deviated toward the central section along the predetermined direction, whereby the generation of white streaks is avoidable when a solid printing is carried out.

3 Claims, 19 Drawing Sheets

METHOD FOR EJECTING LIQUID, LIQUID EJECTION HEAD AND IMAGE-FORMING APPARATUS USING THE SAME

This application is based on Patent Application No. 2001-294663 filed Sep. 26, 2001 in Japan, the content of which is incorporated hereinto by reference

BACKGROUND OF THE INVENTION

1. Field of the Invention

The present invention relates to a method for ejecting liquid by using a liquid ejection head having liquid ejection openings for ejecting liquid, the liquid ejection head itself, and an image-forming apparatus using the same.

In this Specification, a word "print" refers to not only forming a significant information, such as characters and figures, but also forming images, designs or patterns on a printing medium and processing such as etching and so forth in the printing medium, whether the information is significant or insignificant or whether it is visible so as to be perceived by humans. The term "printing medium" includes not only paper used in common printing apparatus, but also sheet materials such as cloths, plastic films, metal sheets, glass plates, ceramic sheets, wood panels and leathers or three-dimensional materials such as spheres, round pipes and so forth which can receive the ink. The word "ink" should be interpreted in its wide sense as with the word "print", refers to liquid that is applied to the printing medium for forming images, designs or patterns, processing such as etching in the printing medium or processing such as coagulating or insolubilizing a colorant in the ink and includes any liquids used for printing.

2. Description of the Related Art

Recently, demand for the high gradation color printing has risen as an internet or a digital camera becomes popular, and an ink jet printers having a higher performance have been developed therewith. The following methods (1) to (3) are known for obtaining a high precision, high gradation and high quality printed image:

(1) The arrangement pitch of openings for ejecting ink is minimized to facilitate the resolution;

(2) A plurality of print heads, each ejecting (at least two kinds of) a specific color ink containing a coloring material of different ratios, i.e. different color concentrations, are prepared and a deep ink and a light ink are selectively printed one over the other if necessary, so that the gradation is improved; and (3) By varying a size or an amount of an ink droplet ejected from the opening, the gradation is improved.

Since the above-mentioned method (3) is relatively difficult to be done in a so-called bubble-jet type printer in which a thermal energy is used for generating a bubble in the ink, a blowing pressure of which is used as an energy for ejecting ink from the opening of the print head, it is thought that the methods (1) and (2) are particularly effective for the bubble-jet type printer.

To realize the method (2), however, two or more print heads are necessary for a specific color ink to result in a high cost. Accordingly, for the bubble-jet type printer, it is most preferable and convenient to adopt a method in which the arrangement pitch of the ejection openings is reduced as in the method (1) and a size of an individual ink droplet ejected from the respective ejection opening is minimized (for example, to 10 picoliter or less) so that the resolution is improved. This is because the production cost hardly rises in this method.

A type for communicating a bubble to an atmosphere via the ejection opening when the small ink droplet is ejected from the ejection opening, which bubble is growing with the heating of ink due to the film boiling is disclosed, for example, in Japanese Patent Application Laid-open Nos. 4-10940 (1992), 4-10941 (1992) and 4-10942 (1992). To differentiate such a type from the conventional bubble-jet type in which the ink droplet is ejected without communicating the bubble growing due to the film boiling with the atmosphere, the former may be called as a bubble-through type.

In the print head of the conventional bubble-jet type in which the ink droplet is ejected without communicating the bubble growing due to the film boiling with the atmosphere, it is necessary to reduce a cross-sectional area of an ink passage communicating with the ejection opening as a size of the ink droplet ejected from the ejection opening becomes smaller. Thereby, an inconvenience may occur in that an ejection speed of the ink droplet is decelerated because of the lowering of ejection efficiency. If the ejection speed of the ink droplet decelerates, the ejecting direction becomes unstable. In addition, the ink is gradually viscous as a moisture is vaporized while the print head is inoperative to cause the ink-ejection to be further unstable, resulting in a premature ejection failure or others. As a result, the reliability may be lowered.

In this respect, the bubble-through type print head in which a bubble communicates with the atmosphere is suitable for ejecting an ink droplet, since a size of the ink droplet could be decided solely by a geometric configuration of the ejection opening. In addition, the bubble-through type print head is advantageous in that it is hardly affected by a temperature or others and an ejection rate of the ink droplet is very stable in comparison with the conventional bubble-jet type print head. Accordingly, it is possible to relatively easily obtain a high precision, high gradation and high quality printed image.

To obtain the high precision, high gradation and high quality printed image, preferably, an extremely small amount of ink droplet is ejected from an individual ejection opening during the printing operation. In this case, it is necessary to eject ink droplets from the ejection opening at a short period for the purpose of obtaining a high printing speed. Further, it is necessary to make a carriage carrying the print head thereon to scan at a high speed relative to a printing medium in synchronism with a drive frequency of the print head. On such a point of view, it could be said that the bubble-through type is particularly suitable for the ink jet printer.

A state of the ejection of ink droplet is depicted in FIG. 16, when a so-called "solid" printing is carried out on a printing medium, in which ink droplets are continuously ejected from all the ejection openings while subjecting the print head of such an ink jet type to the scanning movement at a high speed together with the carriage along the printing medium. The direction of the scanning movement of the print head 1 is vertical to a paper surface of FIG. 16, and the non-illustrated ejection openings are arranged leftward and rightward in the drawing. When the image data is "solid", all of the ejection energy generating elements (not shown) corresponding to the respective ejection openings are driven at a high driving frequency. Therefore, viscous air around the ink droplet 3 ejected from the ejection opening toward the printing medium 2 is also entrained therewith. As a result, a surface area 4 of the print head 1 in which the ejection openings of the print head open is more decompressed than the periphery of the print head 1. Particularly, it has been found that the ink droplets 3 ejected from the ejection openings located at respective opposite ends of the opening arrangement are sucked toward a center along the arrangement, whereby the ink droplet is not directed to a predetermined position on the printing medium 2. It is apparent from the above-mentioned fact that a plurality of ink droplets ejected from the ejection openings disposed in the end section are drawn to a central section.

In addition, as apparent from FIG. 17 showing the relationship between a time in which an ink droplet ejected from the ejection opening disposed in the opposite end section in the arrangement reaches the printing medium and the positional deviation of the ink droplet on the printing medium, a phenomenon that the ejecting direction of the ink droplet 3 deflects due to the above-mentioned air stream becomes significant generally in proportional to a time in which the ink droplet is suffered from the influence of this air stream.

A solid printed image formed on the printing medium is schematically illustrated in FIG. 18 when the scanning movement of the carriage is repeated under such a phenomenon. The carriage scans together with the print head from an upper area to a lower area in the drawing. It will be understood that in this case, a white streak 7 is formed between a solid image 5 formed by the preceding scanning movement and another solid image 6 formed by the subsequent scanning movement.

Such an inconvenience is particularly significant in the ink jet printer having a small arrangement pitch of the ejection openings and ejecting a small amount of ink droplet as little as 10 pico-liter or less at a short period by one drive operation.

To avoid this inconvenience, it is also possible to restrict the deflection of ejection trace of the ink droplet ejected from the ejection opening located at the respective opposite arrangement end by increasing an inertia mass of the ink droplet. The enlargement of the ink droplet size, however, causes the obstruction to the formation of a high precision and high gradation image. Further, the permeation of ink droplet into the printing medium is retarded, and the printed image is liable to deteriorate with the swell of the printing medium. Alternatively, it is also possible to mitigate the above-mentioned inconvenience by suppressing the drive frequency for the ejection energy generating elements to a lower level. When the drive frequency for the ejection energy generating elements is set to a lower level, however, the printing speed becomes too slow to satisfy the user's need for obtaining a high speed printing.

SUMMARY OF THE INVENTION

An object of the present invention is to provide, even in an image-forming apparatus capable of ejecting liquid droplets at a high frequency while scanning transverse to the feeding direction of a printing medium, a liquid ejection head adapted to restrict the deviation of the liquid droplets ejected even from ejection openings disposed in the respective opposite end sections along the arrangement direction to prevent white streaks from generating in a solid printing and an image-forming apparatus using such an ejection head.

Another object of the present invention is to provide a liquid ejection head capable of realizing this liquid ejecting method and an image-forming apparatus using this liquid ejection head.

A first aspect of the present invention is a method for ejecting liquid with a relative motion between a liquid ejection head and a printing medium, the liquid ejection head having a plurality of ejection openings arranged in a predetermined direction and a plurality of ejection energy generating elements for ejecting liquid from the ejection openings, wherein a kinetic energy of the liquid ejected from each ejection opening constituting an end group disposed in respective opposite end sections along the predetermined direction is larger than a kinetic energy of the liquid ejected from each ejection opening constituting a central group disposed in a central section along the predetermined direction.

According to the first aspect of the present invention, by increasing the kinetic energy of the liquid ejected from each ejection opening constituting the end group:

(1) since the time required for the liquid droplet to reach the printing medium becomes short, it is possible to reduce the positional deviation of the liquid droplet reaching the printing medium against the phenomenon in which the liquid droplet ejected from the ejection opening is drawn toward the central section along the predetermined direction due to the influence of the air stream;

(2) Since the energy of the air stream generated by the liquid droplets ejected from each ejection openings constituting the end group increases, an air stream flowing from the respective opposite end sections toward the central section is weakened; and (3) The linearity of the liquid ejected from each ejection opening in the end group is improved.

As a result, the liquid is less influenced by the air stream generated by the continuously ejected liquid from the respective ejection openings. It is also possible to determine a flight speed of the liquid ejected from each ejection opening constituting the end group to be higher than that of the liquid ejected from the ejection opening constituting the central group.

In the method for ejecting liquid according to the first aspect of the present invention, the kinetic energy of the liquid ejected from each ejection opening constituting the end group may lie in the range from 1.2 to 5 times the kinetic energy of the liquid ejected from each ejection opening constituting the central group. In this case, it is possible to correct the position of the liquid droplet finally reaching the printing medium to the predetermined one, and to obtain a high quality image of high grade and high precision free from white streaks even if the solid printing is carried out. When the kinetic energy of the liquid ejected from each ejection opening constituting the end group is 1.2 times or more than that of the liquid ejected from each ejection opening constituting the central group, the effect of the present invention is more clearly obtainable. However, the kinetic energy of the liquid ejected from each ejection opening constituting the end group exceeds 5 times that of the liquid ejected from each ejection opening constituting the central group, there is a risk in that part of the liquid droplets ejected from the ejection openings constituting the central group adjacent to the end group is influenced by the air stream generated by the liquid droplets ejected from the ejection openings constituting the end group and to be reversely brought toward the respective opposite end sections.

A second aspect of the present invention is a method for ejecting liquid with a relative motion between a liquid ejection head and a printing medium, the liquid ejection head having a plurality of ejection openings arranged in a predetermined direction and a plurality of ejection energy generating elements for ejecting liquid from the ejection openings, wherein a flight speed of the liquid ejected from each ejection opening constituting an end group disposed in respective opposite end sections along the predetermined direction is higher than a flight speed of the liquid ejected from each ejection opening constituting a central group disposed in a central section along the predetermined direction.

According to the second aspect of the present invention, since the flight speed of the liquid ejected from each ejection opening constituting the end group is set at a high level, the linearity of the liquid ejected from each ejection opening constituting the end group is improved, and the liquid ejected from the ejection opening is hardly suffered from the influence of an air stream accompanied with the continuous ejection of the liquid from the respective ejection openings. Therefore, it is possible to correct a final position of the liquid droplet reaching the printing medium to a desired position, and to obtain a high quality image of high grade and high precision free from white streaks even if the solid printing is carried out.

In the method for ejecting liquid according to the second aspect of the present invention, the flight speed of the liquid ejected from each ejection opening constituting the end group is preferably three times or less the flight speed of the liquid ejected from each ejection opening constituting the central group. When the flight speed of the liquid ejected from each ejection opening constituting the end group exceeds three times that the liquid ejected from each ejection opening constituting the central group, there is a risk in that part of the liquid droplets ejected from the ejection openings constituting the central group adjacent to the end group is influenced by the air stream generated by the liquid droplets ejected from the ejection openings constituting the end group and to be reversely brought toward the respective opposite end sections.

In the method for ejecting liquid according to the first or second aspect of the present invention, a driving signal supplied to the ejection energy generating element for ejecting the liquid from the ejection opening one time may have a plurality of pulse signals, and a first pulse signal length supplied to the ejection energy generating element corresponding to the ejection opening in the end group may be longer than a first pulse signal length supplied to the ejection energy generating element corresponding to the ejection opening in the central group. In this case, it is possible to increase the flight speed of the liquid ejected from each ejection opening constituting the end group disposed in the respective opposite end sections to be larger than that of the liquid ejected from each ejection opening constituting the central group disposed in the central section. Additionally, it is possible to correct a final position of the liquid droplet reaching the printing medium to a desired position, and to obtain a high quality image of high grade and high precision free from white streaks even if the solid printing is carried out.

The ejection energy generating elements corresponding to the end group may be driven at a final stage of the drive period of all the ejection energy generating elements. In this case, even if the liquid droplet ejected from each ejection opening constituting the end group disposed in the respective opposite end sections has a speed higher than that of the liquid droplet ejected from each ejection opening constituting the central group disposed in the central section, it is possible to precisely correct a position of the liquid droplet finally reaching the printing medium.

A third aspect of the present invention is a liquid ejection head for ejecting liquid having a plurality of ejection openings arranged in a predetermined direction and a plurality of ejection energy generating elements for ejecting liquid from the ejection openings, the liquid ejection head being in the relative motion with the printing medium, wherein an opening area of each ejection opening constituting a central group disposed in a central section along the predetermined direction is larger than an opening area of each ejection opening constituting an end group disposed in respective opposite end sections along the predetermined direction.

FIG. 19 represents the relationship between a volume of the liquid droplet ejected from the ejection opening and the positional deviation of the liquid droplet reaching the printing medium. As will be understood from FIG. 19, the larger the volume of the liquid droplet ejected from the ejection opening, the smaller the influence of the air stream generated due to the continuous ejection of the liquid from the ejection opening. An acceleration $\alpha$ of the liquid droplet caused by the influence of this air stream is in proportion to a drag D and in reverse proportion to a mass of the liquid droplet. The drag D is represented by the following equation:

$$D=C_D\times(\rho/2)\times V^2\times F$$

wherein $C_D$ is a drag coefficient, $\rho$ is a density of air, V is a air stream speed and F is a projected area of the liquid droplet. If F/M is taken into account, since the projected area F is in proportion to a square of a diameter of the liquid droplet and the mass M of the liquid droplet is in proportion to a cube of the diameter of the liquid droplet, it is apparent that the larger the volume of the liquid droplet, the less the influence of the air stream on the liquid droplet.

According to the third aspect of the present invention, since the opening area of each ejection opening constituting the end group is smaller than that of each ejection opening constituting the central group, a volume of the liquid droplet ejected from each ejection opening constituting the end group is larger than that of the liquid droplet ejected from each ejection opening constituting the central group and the flight speed of the liquid ejected from each ejection opening constituting the end group becomes relatively higher. As a result, the liquid ejected from each ejection opening constituting the end group is hard to be suffered from the influence of air stream generated accompanied with the continuous ejection of the liquid from the respective ejection openings. Additionally, it is possible to increase the flight speed of the liquid ejected from the ejection opening disposed in the opposite end section in the arrangement to constitute the end group to be larger than that of the liquid ejected from the ejection opening disposed in the central section in the arrangement to constitute the central group.

In the liquid ejection head according to the third aspect of the present invention, the opening area of each ejection opening constituting the central group may be twice or less the opening area of each ejection opening constituting the end group. In this case, it is possible to correct the final position of the liquid droplet reaching the printing medium to the predetermined position, whereby even if the solid printing is carried out, a high quality image of high grade and high precision free from white streaks is obtainable. When the opening area of the ejection opening constituting the central group exceeds twice the opening area of the ejection opening constituting the end group, there is a risk in that the difference becomes significant in quality of the image formed on the printing medium between the ejection openings in the end group and those in the central group.

The liquid ejection head may further comprise a plurality of nozzles. In this case, each nozzle may communicate with the ejection opening at a tip end thereof, and the nozzle corresponding to each ejection opening in the end group may be formed by a tapered hole which is tapered toward the ejection opening. Alternatively, the nozzle corresponding to the end group may be formed by a stepped hole which has a smaller cross-sectional portion defining the ejection opening at the tip end and at least one larger cross-sectional portion larger than the smaller cross-sectional portion. In this case, it is possible to assuredly increase the flight speed of the ejection opening constituting the end group disposed in the opposite end section along the predetermined direction.

A fourth aspect of the present invention is a liquid ejection head having a plurality of ejection openings arranged in a predetermined direction, a plurality of nozzles communicated with the ejection openings at the tip end thereof and a plurality of ejection energy generating elements for ejecting liquid from the ejection openings, the liquid ejection head being in the relative motion with a printing medium, wherein a viscous drag of the nozzle communicating with each ejection opening which constitutes an end group disposed in the respective opposite end sections along the predetermined direction is smaller than a viscous drag of the nozzle communicating with the ejection opening which constitutes a central group disposed in a central section along the predetermined direction.

According to the fourth aspect of the present invention, since the linearity of the liquid ejected from each ejection opening constituting the end group is improved, the liquid ejected from the ejection opening is hardly suffered from the influence of an air stream accompanied with the continuous ejection of the liquid from the respective ejection openings.

In the liquid ejection head according to the fourth aspect of the present invention, the nozzle may be formed by a tapered hole which is tapered toward the ejection opening, and a taper angle of the nozzle corresponding to each ejection opening constituting the end group may be larger than a taper angle of the nozzle corresponding to each ejection opening constituting the central group. Alternatively, the nozzle corresponding to each ejection opening constituting the end group may be formed by a stepped hole having a smaller cross-sectional portion which defines the ejection opening at a tip end and at least one larger cross-sectional portion larger than the smaller cross-sectional portion. The nozzle also may be formed by a stepped hole having a smaller cross-sectional portion which defines the ejection opening at a tip end and at least one larger cross-sectional portion larger than the smaller cross-sectional portion, a length of a passage of the smaller cross-sectional portion of each nozzle corresponding to the end group may be shorter than a length of a passage of the smaller cross-sectional portion of each nozzle corresponding to the central group. In this case, it is possible to assuredly increase the flight speed of each ejection opening constituting the end group disposed in the respective opposite end sections along the predetermined direction.

A fifth aspect of the present invention is a liquid ejection head for ejecting liquid having a plurality of ejection openings arranged in a predetermined direction and a plurality of ejection energy generating elements for ejecting liquid from the ejection openings, the liquid ejection head being in the relative motion with the printing medium, wherein an area of the energy generating element corresponding to each ejection opening constituting an end group disposed in respective opposite end sections along the predetermined direction is larger than an area of the energy generating element corresponding to each ejection opening constituting a central group disposed in a central section along the predetermined direction.

According to the fifth aspect of the present invention, since the area of each ejection energy generating element corresponding to the ejection opening in the end group increases to be larger than that of the ejection energy generating element corresponding to each ejection opening in the central group, the volume of the liquid droplet ejected from each ejection opening constituting the end group becomes larger than the volume ejected from each ejection opening constituting the central group, and receives a larger heat energy to increase the flight speed as well as to shorten the time required for the liquid ejected from the ejection opening constituting the end group reaching the printing medium. As a result, the liquid ejected from each ejection opening constituting the end group is hard to be suffered from the influence of air stream generated accompanied with the continuous ejection of the liquid from the respective ejection openings. Therefore, it is possible to increase the flight speed of the liquid ejected from each ejection opening constituting the end group disposed in the respective opposite end section to be larger than that of the liquid ejected from each ejection opening constituting the central group disposed in the central section.

In the liquid ejection head according to the fifth aspect of the present invention, the area of the energy generating element corresponding to the ejection opening in the end group is preferably twice or less the area of the energy generating element corresponding to the ejection opening in the central group. In this case, it is possible to correct the final position of the liquid droplet reaching the printing medium to the predetermined position, whereby even if the solid printing is carried out, a high quality image of high grade and high precision free from white streaks is obtainable. When the area of the ejection energy generating element corresponding to the ejection opening in the end group exceeds twice that of the ejection energy generating element corresponding to the ejection opening in the central group, the environment temperature of the ejection energy generating element corresponding to the ejection opening constituting the end group may become different from that of the ejection energy generating element corresponding to the ejection opening constituting the central group, whereby there is a risk in that the difference in quality of image formed on the printing medium becomes significant between the end group ejection openings and the central group ejection openings.

The wiring resistance of the ejection energy generating element corresponding to each ejection opening in the end group is preferably larger than a wiring resistance of the ejection energy generating element corresponding to each ejection opening in the central group. In this case, even if the area of the ejection energy generating element is changed, it is possible to correct all the drive times of the driving signals at an equal time.

In the liquid ejection head according to any one of the third to fifth aspects of the present invention, the predetermined direction may be the feeding direction of the printing medium, and the liquid ejection head may be scanned in a scanning direction transverse to the predetermined direction.

The plurality of ejection energy generating elements may be disposed respective opposite to the plurality of ejection openings. In this case, a position of each ejection opening constituting the end group may be shifted in the scanning direction of the liquid ejection head, or a position of the ejection energy generating element corresponding to each ejection opening constituting the end group may be reversely shifted in the scanning direction of the liquid ejection head. As a result, even if the flight speed of the liquid droplet ejected from each ejection opening constituting the end group disposed in the respective opposite end section is higher than that of the liquid droplet ejected from the ejection opening constituting the central group disposed in the central section, it is possible to precisely correct a position of the liquid droplet finally reaching the printing medium.

The number of the ejection openings constituting the end group is preferably ¼ or less of all the ejection openings formed in the liquid ejection head. Especially, the number of the ejection openings constituting the end group lies preferably in the range from 2 to 64. When the number of the ejection openings constituting the end group exceeds 64, there is a risk in that the liquid droplet ejected from one or more of the ejection openings constituting the end group disposed respective opposite to the central group tends to deviate inwardly along the predetermined direction.

The ejection energy generating element may have an electro-thermal transducer for generating heat energy for ejecting the liquid from the ejection opening by generating the film boiling in the liquid.

A sixth aspect of the present invention is an image-forming apparatus comprising an attaching portion for the liquid ejection head according to any one of the third to fifth aspects of the present invention, the attaching portion including a carriage scanned in the direction transverse to the feeding direction of a printing medium, and means for feeding the printing medium, wherein an image is formed on the printing medium by the liquid ejected from the ejection openings of the liquid ejection head.

In the image-forming apparatus according to the sixth aspect of the present invention, the liquid ejection head may be detachably attached to the carriage by attaching/detaching means, a scanning speed of the carriage lies preferably in the range from 10 to 100 cm/sec. When the scanning speed of the carriage is higher than 10 cm/sec, the influence of the air stream accompanied with the scanning motion of the carriage becomes larger to enhance the effect of the present invention. When the scanning speed of the carriage is 100 cm/sec or less, the influence of the air stream accompanied with the scanning motion of the carriage is relatively weak, whereby it is possible to sufficiently enhance the effect of the present invention even if the number of the ejection openings in the end group is relatively small.

An amount of liquid ejected from the individual ejection opening is preferably in a range from 0.2 to 10 pico-liter. If the amount of liquid is less than 0.2 pico-liter, a volume of the liquid droplet is so small to be liable to deviate toward the central section in the arrangement, whereby it is necessary to sufficiently increase the number of ejection openings in the end group. If the amount of the liquid exceeds 10 pico-liter, the volume of the liquid droplet becomes large to be hardly influenced by the air stream, whereby it is impossible to sufficiently enjoy the effect of the present invention.

The liquid may be an ink and/or a treatment liquid for controlling the printing property of the ink relative to the printing medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

One embodiment in which an image-forming apparatus according to the present invention is applied to an ink jet printer will be described in detail below with reference to FIGS. 1 to 15. The present invention, however, should not be limited to such embodiments but includes the combinations thereof or other technologies contained in the concept of the present invention defined by the scope of claim for the patent.

First Embodiment

Figure 1:
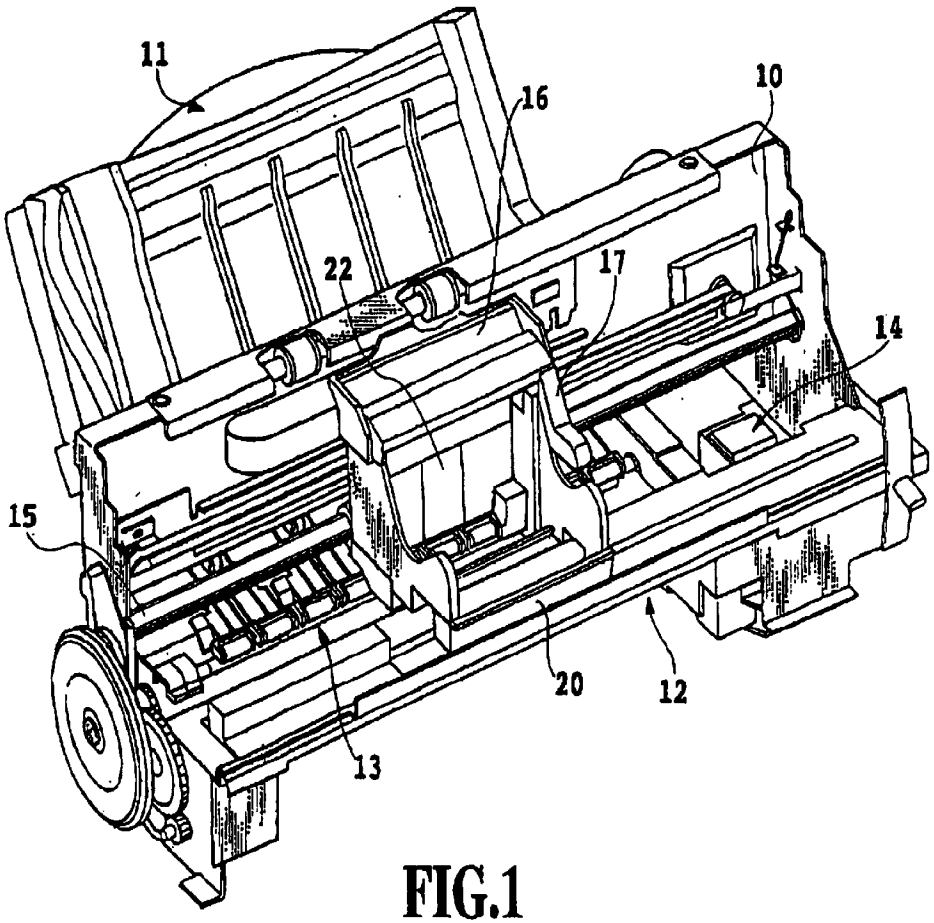
FIG. 1 is a perspective view illustrating a schematic structure of one embodiment of an image-forming apparatus according to the present invention applied to an ink jet printer.
Figure 2:
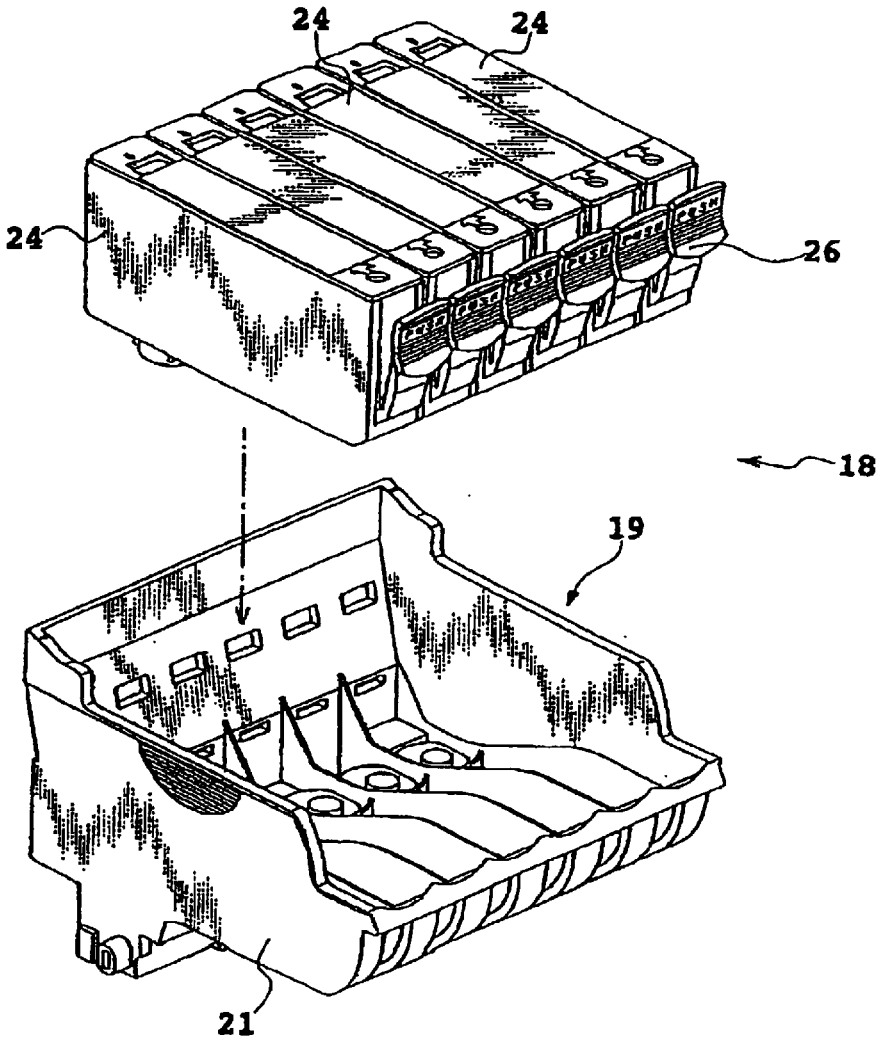
FIG. 2 is a perspective view of an appearance of a head cartridge used in the ink jet printer shown in FIG. 1, wherein ink tanks are removed.
Figure 3:
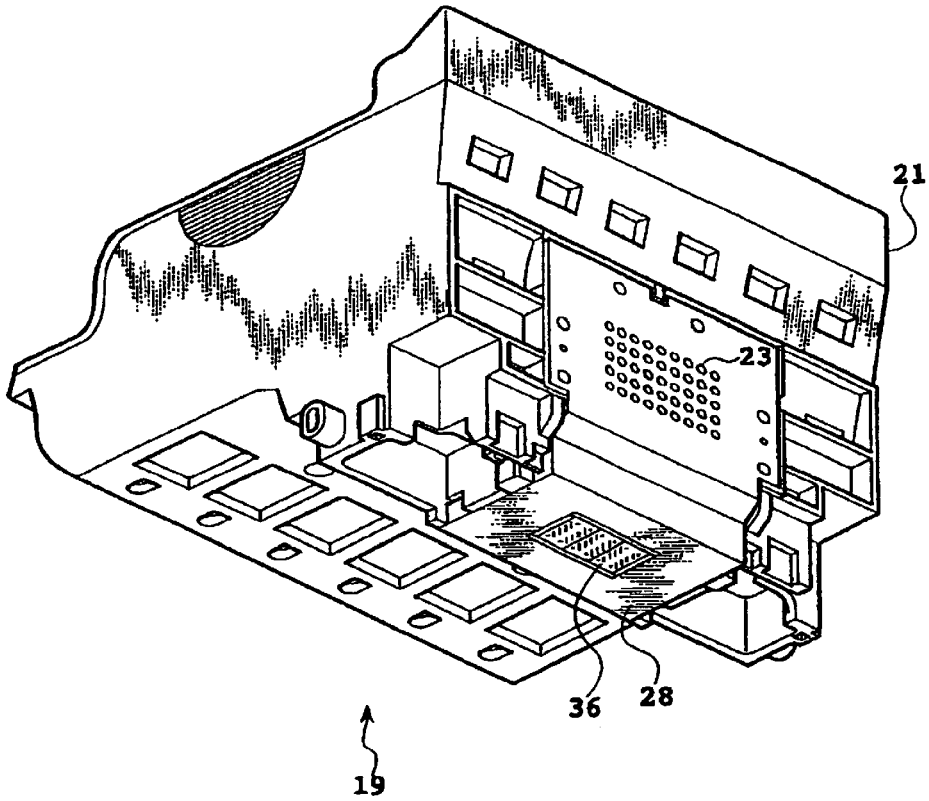
FIG. 3 is an exploded perspective view of the head cartridge shown in FIG. 2.

An appearance of a mechanism of an ink jet printer according to this embodiment is shown in FIG. 1; an appearance of the head cartridge used in this ink jet printer is shown in FIG. 2 in an exploded manner; and an appearance of a print head thereof is shown in FIG. 3. A chassis 10 of the ink jet printer of this embodiment consists of a plurality of pressed sheet metals having a predetermined rigidity to form a skeleton of the ink jet printer. In the chassis 10, there are incorporated a medium supplying part 11 for automatically feeding a printing medium not shown into the interior of the ink jet printer, a medium feeding part 13 for guiding the printing medium fed one by one from the medium supplying part 11 to a desired printing position and introducing the same from the printing position into a medium discharging part 12, a printing part for carrying out the predetermined printing operation on the printing medium fed to the printing position, and a head recovery part 14 for carrying out the recovery process on the printing part.

The printing part includes a carriage 16 held on a carriage shaft 15 to be movable along the latter, and a head cartridge 18 detachably mounted onto the carriage 16 via a head set lever 17.

The carriage 16 mounting the head cartridge 18 includes a carriage cover 20 for positioning a print head 19 of the head cartridge 18 at a predetermined mounting position on the carriage 16, and the above-mentioned head set lever 17 engageable with a tank holder 21 of the print head 19 to press and locate the print head 19 at the predetermined mounting position. The head set lever 17 used as attachment/detachment means of the present invention is provided in an upper portion of the carriage 16 to be rotatable in relation to a head set lever shaft (not shown). A head set plate (not shown) is provided at a position engaged with the print head 19 while being biased with a spring. The print head 19 is mounted to the carriage 16 while being pressed by the spring force.

One end of a contact flexible print cable (not shown, hereinafter referred to as contact FPC) is connected to another engaging part of the carriage 16 with the print head 19. A contact part (not shown) formed at the end of the contact FPC 22 is electrically connected to a contact part 23 which is provided in an external signal input terminal in the print head 19 to enable input/output of various kinds of information for the printing operation or a power supply to the print head 19.

There is an elastic member such as rubber (not shown) between the contact part of the contact FPC 22 and the carriage 16. By the elasticity of the elastic member and the pressure of the head set plate, the contact of the contact part of the contact FPC 22 with the contact part 23 of the print head 19 is ensured. The other end of the contact FPC 22 is connected to a carriage base (not shown) mounted on a back side of the carriage 16.

The head cartridge 18 of this embodiment has ink tanks 24 storing ink and the above-mentioned print head 19 for ejecting ink supplied from the ink tanks 24 through ejection openings 25 (see FIG. 4) of the print head 19 in accordance with the print information. The print head 19 of this embodiment employs a so-called cartridge type in which it is mounted to the carriage 16 in a detachable manner.

Since a high-quality color print of a photographic gradation is obtainable according to this embodiment, independent six ink tanks 24 of color ink, for example, of black, pale cyan, pale magenta, cyan and magenta are usable. In the respective ink tank 24, an elastically deformable detachment lever 26 is provided to be engageable with the head cartridge 18. By operating this detachment lever 26, the ink tank 24 is detachable from the print head 19 as shown in FIG. 3. Thus, the detachment lever 26 functions as part of the attachment/detachment means of the present invention.

Figure 4:
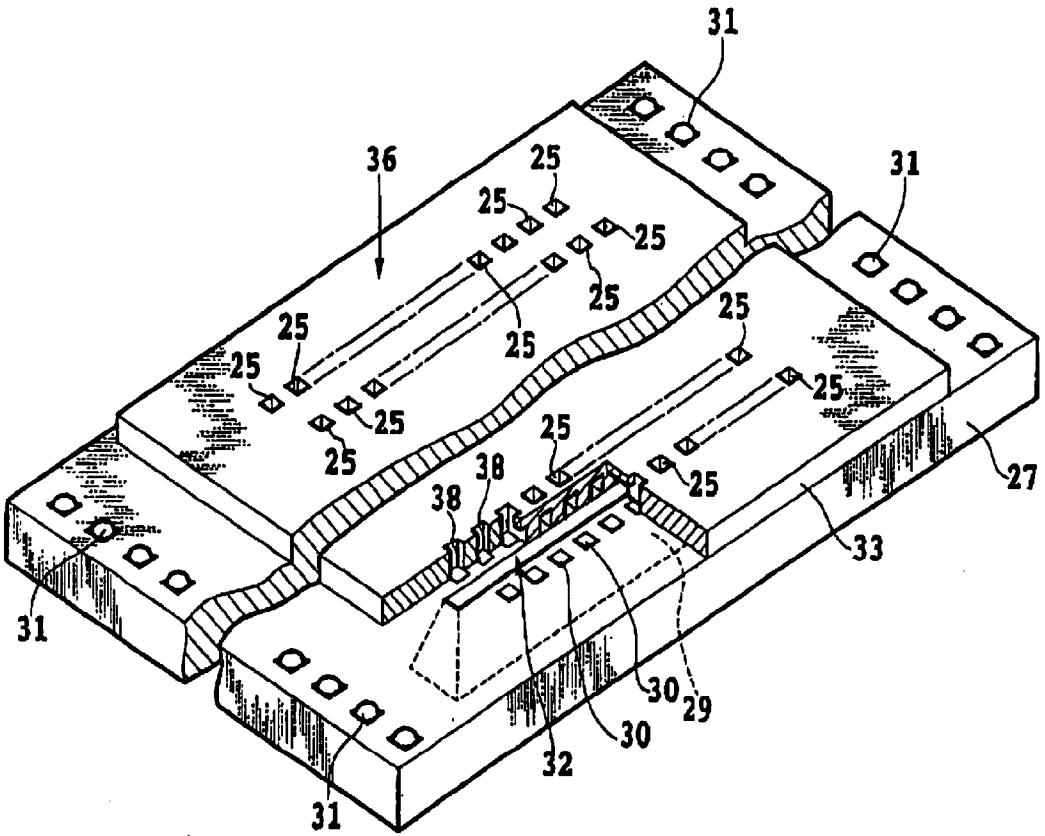
FIG. 4 is a broken perspective view of the liquid ejection head according to the present invention applied to the ink jet printer shown in FIG. 1.
Figure 5:
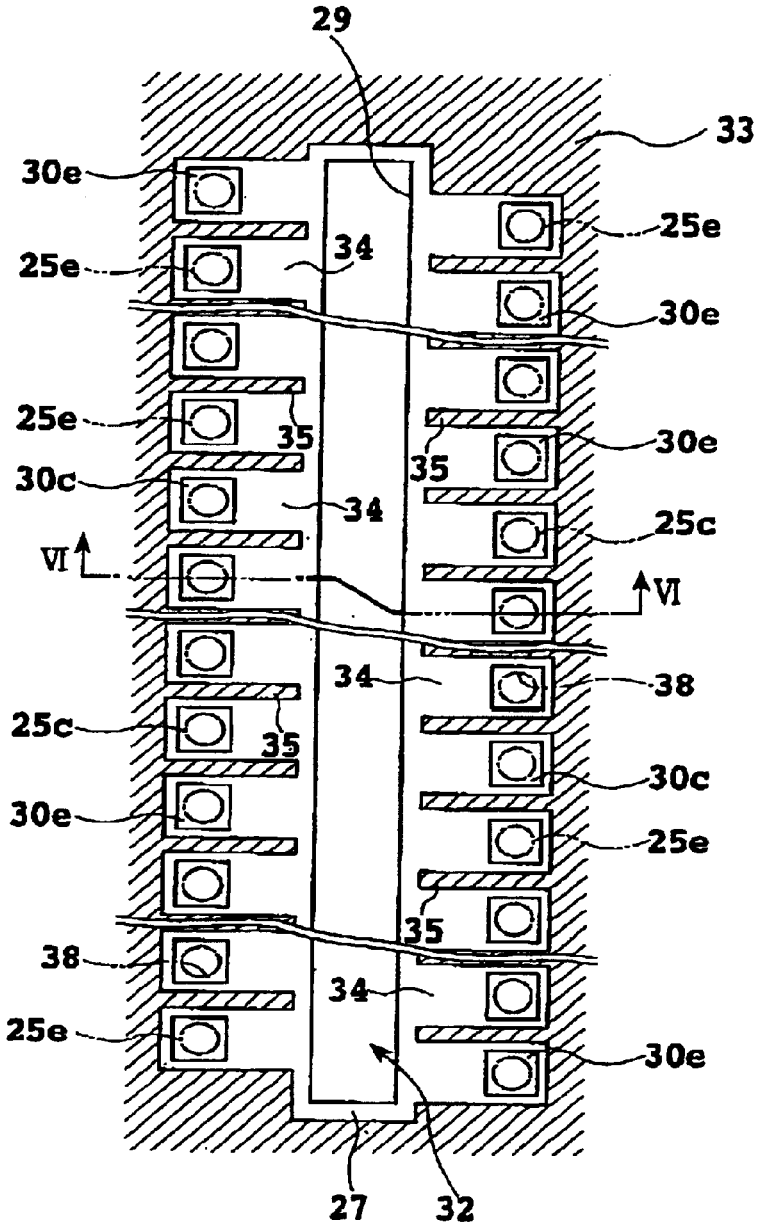
FIG. 5 is a broken plan view illustrating the arrangement of ejection openings and electro-thermal transducers in the print head shown in FIG. 4.
Figure 6:
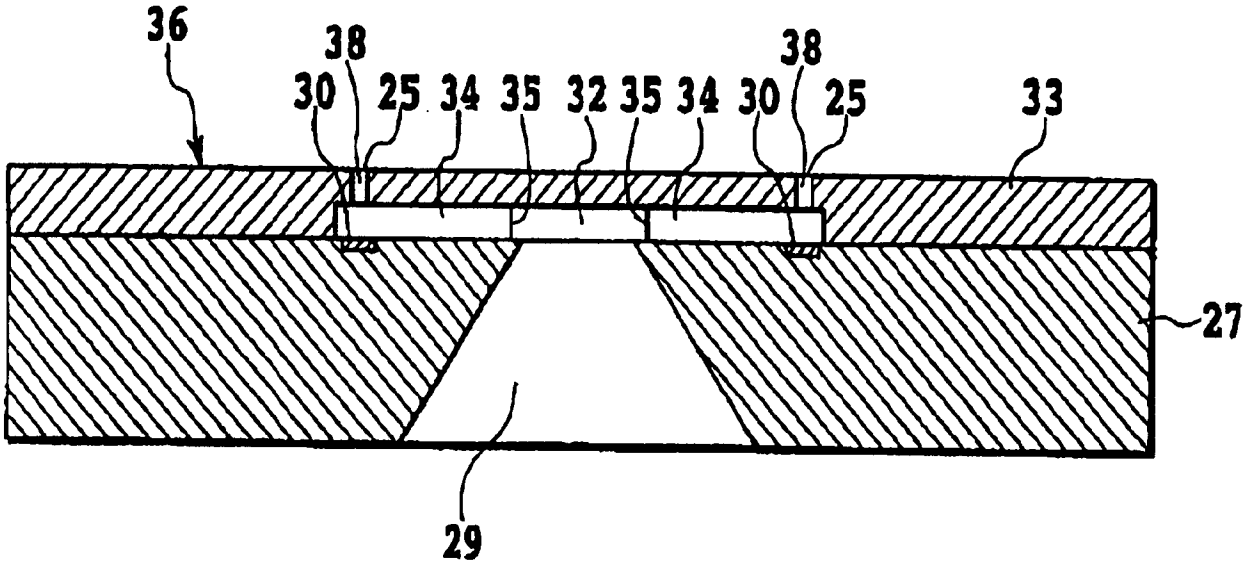
FIG. 6 is a sectional view taken along a line VI—VI in FIG. 5.

The print head 19 includes a printing element substrate 27, an electric wiring substrate 28 described later and the above-mentioned tank holder 21. FIG. 4 illustrates a broken structure of the printing element substrate 27 of the print head 10 according to this embodiment; FIG. 5 illustrates the arrangement of the ejection openings 25 and the electro-thermal transducers in the print head 19; and FIG. 6 illustrates a sectional view thereof taken along a line VI—VI. The printing element substrate 27 of this embodiment is a silicon substrate of 0.5 to 1 mm thick, on which are formed an ejection energy generating section, a common ink chamber 32, ink passages 34, and nozzles 38, each having an ejection opening 25 at a tip end, by a deposition technique. In the printing element substrate 27, an elongate ink supply opening 29 is formed to pass through the same. On the opposite side of the ink supply opening 29, a plurality of electro-thermal transducers 30 which are the ejection energy generating elements are arranged in two rows (one row is formed by 128 transducers) at a predetermined pitch in the feeding direction of the printing medium, that is, in the longitudinal direction of the ink supply opening 29, wherein the electro-thermal transducers 30 in the one row is shifted by half a pitch relative to those in the other row. In the printing element substrate 27, besides the electro-thermal transducers 30, electrode terminals 31 for the electric connection of the electro-thermal transducer 30 with the printer body and electric wirings of aluminum or the like not shown are formed by the deposition technique.

The electric wiring substrate 28 connected to the electrode terminals 31 formed in the printing element substrate 27 supplies electric signals to the printing element substrate 27 for ejecting ink. The electric wiring substrate 28 has electric wirings in correspondence to the printing element substrate 27, and the contact section 23 described before for receiving electric signals from the printer body. The contact section 23 is positioned and secured to a back surface of the tank holder 21. The driving signal is supplied to the electro-thermal transducer 30 from a drive IC not shown via the electric wiring substrate 28, and simultaneously therewith, a drive power is supplied to the electro-thermal transducer 30.

In the tank holder 21 holding ink tanks 24 in a detachable manner, an ink flowing passage is formed from the individual ink tank 24 to the ink supply opening 29 of the printing element substrate 27.

On the printing element substrate 27, an upper plate member 33 is formed, having a plurality of nozzles 38 opposed to the electro-thermal transducers 30, respectively, via the common ink chamber 32 communicated with the ink supply opening 29. A tip end of the nozzle 38 constitutes the ejection opening 25. The ink passages 34 communicating with the individual nozzles 38 and with the common ink chamber 32 are formed between the upper plate member 33 and the printing element substrate 27, and a partition wall 35 is formed between every adjacent ink passages 34. The common ink chamber 32, the ink passages 34 and the partition walls 35 are formed together with the upper plate member 33 by a photo-lithographic technique similarly to the nozzle 38 having the ejection opening 25 at an open end thereof.

Liquid to be supplied to the respective ink passage 34 from the ink supply opening 29 is boiled as the electro-thermal transducer 30 opposed thereto is heated by the driving signal supplied to the latter, and ejected from the ejection opening 25 of the nozzle 38 due to a pressure of a bubble generated by the boiling. In this case, the bubble generated in the liquid chamber 32 is communicated with the outer air through the ejection opening 25 as it develops.

As described above, in this embodiment, the arrangement pitch of 128 ejection openings 25 in one row; i.e., that of the electro-thermal transducers 30; is 42.3 μm (corresponding to 600 dpi). The ejection openings 25 in the other row are shifted half a pitch relative to those of the one row as seen in the arrangement direction. Accordingly, 256 ejection openings 25 of the two rows are arranged at 1200 dpi The respective electro-thermal transducer 30 has a 24 μm square shape. The respective ejection opening 25 has a circular shape of a 15.5 μm diameter. In this embodiment, a drive voltage of 11.0 V is selectively applied to the individual electro-thermal transducer 30 at a period of 15 kHz. Accordingly, in any one of the ejection openings 25, a time interval of the ejection of ink droplet is approximately 67 μs at the shortest. By one drive pulse signal, an ink droplet of 4.5 pico-liter (pl) is ejected from the individual ejection opening 25 to form a dot of 48 μm diameter on the printing medium.

Figure 7:
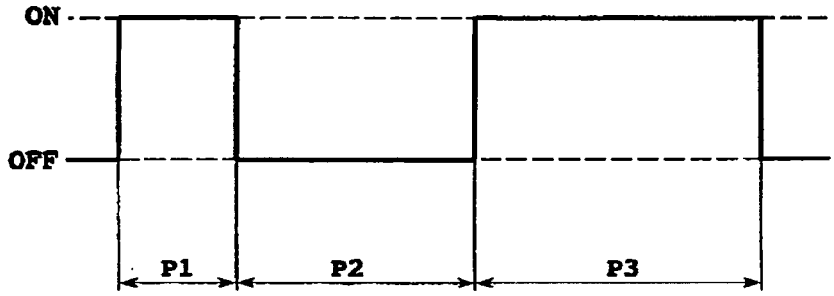
FIG. 7 is a wave shape of a driving signal supplied to the electro-thermal transducer.
Figure 8:
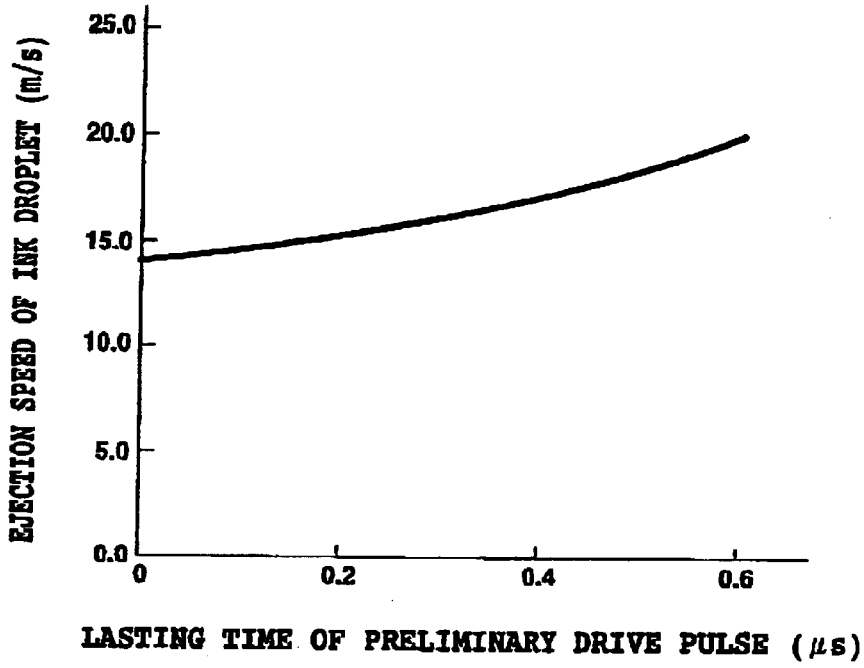
FIG. 8 is a graph representing a relationship between the lasting time of a preliminary drive pulse for the driving signal shown in FIG. 7 and an ejection speed of an ink droplet ejected from the ejection opening.
Figure 9:
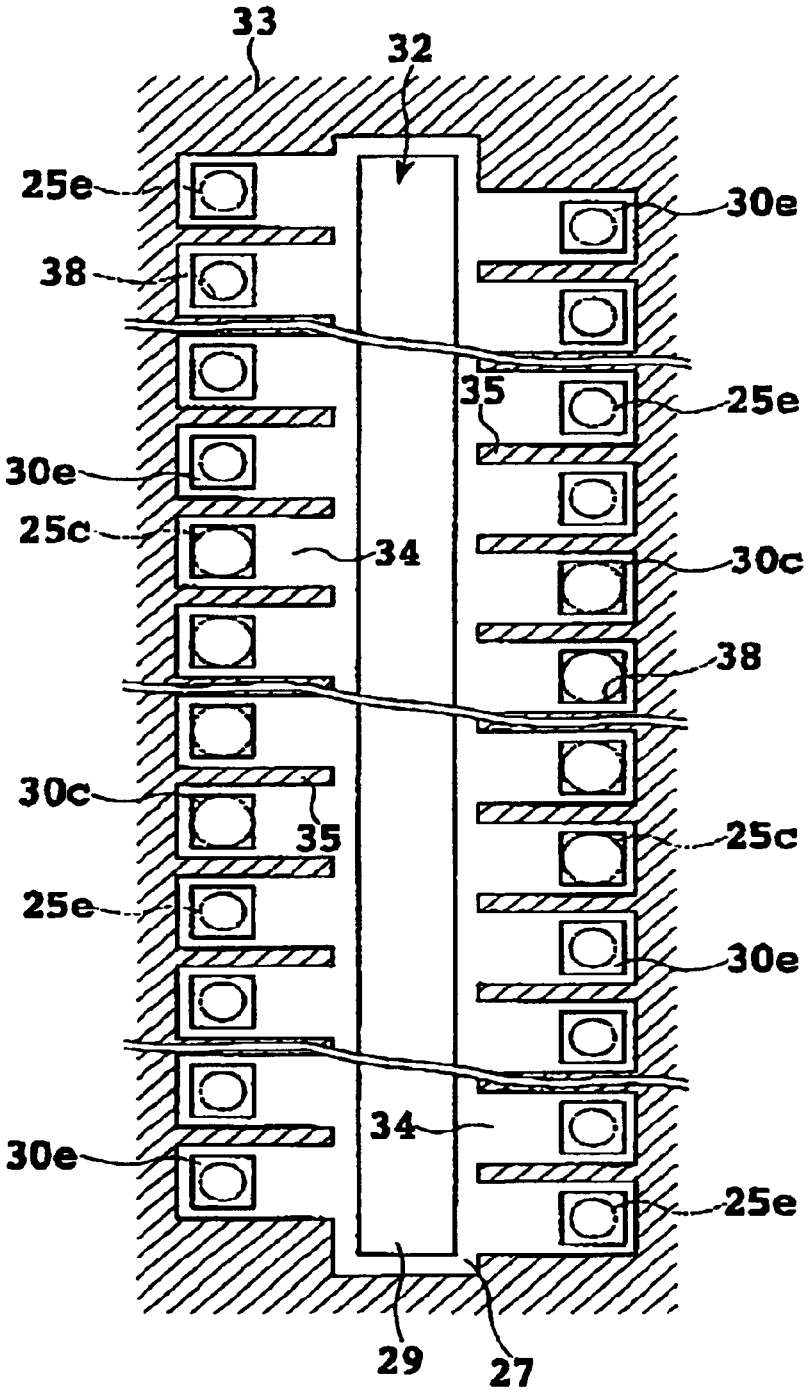
FIG. 9 is a broken plan view illustrating the arrangement of ejection openings and electro-thermal transducers in the print head according to another embodiment of the present invention.

According to this embodiment, sixteen ejection openings 25*e* counted from the endmost one of the arrangement in the individual row constitutes an end group of the ejection openings. An ejection speed (a flight speed) of the ink droplet ejected from each of 64 ejection openings 25*e* constituting all the end groups is larger than 14 m/s which is an ejection speed of the ink droplet ejected from each of the other 192 ejection openings 25*c* constituting a central group. Concretely, a wave shape of the drive pulse is as shown in FIG. 7 which is the wave shape of the drive pulse supplied to the electro-thermal transducers 30*e* for the sixteen ejection openings 25*e* constituting the end group to obtain the ejection speed of the ink droplet ejected therefrom becomes 20 m/s, wherein the drive pulse is divided into two parts $P_1$ and $P_3$ with the intervention of a pause $P_2$, for example, of 1.0 μs. In this case, the first preliminary drive pulse $P_1$ has a function for rising the temperature of ink in the vicinity of the electro-thermal transducer 30*e*. The main drive pulse $P_3$ lasting, for example, 1.5 μm supplied after the pause $P_2$ has a function for ejecting the ink droplet from the ejection opening 25*e*. As shown in FIG. 8 representing the relationship between the lasting time of the preliminary drive pulse $P_1$ and the ejection speed of the ink droplet, it will be understood that there is a tendency that the longer the preliminary drive pulse, the higher the ejection speed of the ink droplet ejected from the ejection opening 25*e*. As apparent from FIG. 8, when no preliminary drive pulse $P_1$ is supplied, the ink droplet is ejected from the ejection opening 25*c* at the ejection speed of 14 m/s. Contrarily, if the preliminary drive pulse $P_1$ lasts for 0.6 μs, it is possible to eject the ink droplet at the ejection speed of 20 m/s from the ejection opening 25*e*.

Figure 18:
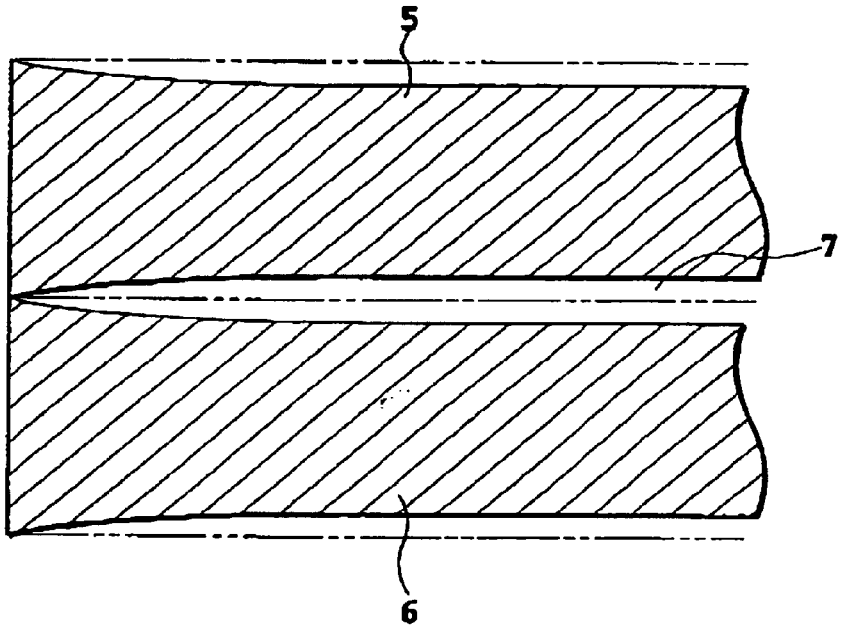
FIG. 18 is a conceptual view illustrating a solid image formed by the ejection of ink on the printing medium in accordance with the manner shown in FIG. 16.
Figure 19:
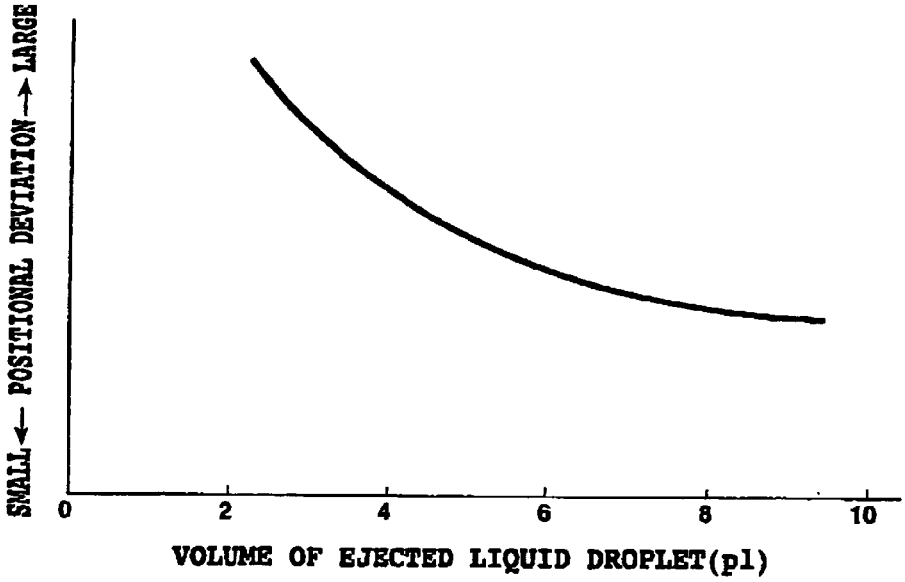
FIG. 19 is a graph representing the relationship between a volume of the ink droplet ejected from the ejection opening and an amount of deviation of a position on the printing medium at which the ink droplet actually reaches from the target position.

When the print head 19 of this ink jet system is subjected to the scanning motion at a high speed along the printing medium together with the carriage 16 while continuously ejecting ink droplets from all the ejection openings 25 to carry out a so-called solid printing on the printing medium, it has been found that a gap of a white streak as shown in FIG. 18 becomes as large as approximately 60 μm if the wave shapes of the drive pulse supplied to all the electro-thermal transducers 30 are equal to each other. Contrary to this, in this embodiment, since the ejection speed of the ink droplet ejected from 64 ejection openings 25*e* disposed in the opposite end section in the arrangement to constitute the end group is higher than the ejection speed of the ink droplet ejected from the ejection openings 25*c* constituting the central group, the ink droplet having a large kinetic energy is ejected from the ejection opening 25*e* constituting the end group against the negative pressure atmosphere generated in the central section of the arrangement of the ejection openings 25, whereby the linearity of the ink droplet from the ejection opening 25*e* is improved to reduce the gap of the white streak to 27 μm. As a result, the white streak generating at every scanning motion of the carriage 16 in the prior art is not so conspicuous.

When the above-mentioned printing operation is carried out, a distance between the printing medium and an ejection opening surface 36 in which the ejection opening 25 of the print head 19 opens is 1.5 mm, and the scanning speed of the carriage 16 is 317.5 mm/s so that a dot density in the direction of the scanning movement of the carriage 16 is 1200 dpi. A density of the ink is 1.05.

Second Embodiment

In the above-mentioned embodiment, the ejection speed of the ink droplet ejected from the ejection opening 25*e* in the end group disposed in the respective opposite end section is increased higher than that of the ink droplet ejected from the ejection opening 25*c* in the central group by adding the preliminary drive pulse $P_1$ to the main drive pulse $P_3$ supplied to the electro-thermal transducer 30*e* and by properly adjusting a drive time of the preliminary drive pulse $P_1$. However, the ejection speed of the ink droplet ejected from the ejection opening 25*e* may be increased higher than that of the ink droplet ejected from the ejection opening 25*c* by changing a shape of the ejection openine 25*e* or the nozzle 38 constituting the end group disposed in the opposite end section in the arrangement direction.

The arrangement of the ejection openings 25 of the liquid ejection heads described above is shown in FIG. 9. In this embodiment, the same reference numerals are used for denoting elements having the same functions as in the preceding embodiment, and the duplication of the explanation will be eliminated. According to this embodiment, as a print head, 128 ejection openings 25 are arranged in two rows at an arrangement pitch of 300 dpi while shifting half a pitch between the two rows in the arrangement direction, so that 256 ejection openings 25 in the two rows are arranged at an arrangement pitch of 600 dpi. A volume of the ink droplet ejected from the respective ejection opening 25 is 8.0 pl and a density of ink used is 1.05. A drive frequency applied to the electro-thermal transducer 30 is 10 kHz, and the scanning speed of the carriage 16 is 423 mm/s so that a density of dots formed on the printing medium along the direction of the scanning motion of the carriage 16 becomes 600 dpi. In this case, considering one ejection opening 25, a time interval for ejecting the ink droplets is approximately 100 μm at the least.

Also in this embodiment, the ejection speed (a flight speed) of the ink droplet ejected from the ejection opening 25*e* in the end group from the first to the sixteenth ejection openings as counted from the endmost one in the arrangement is higher than 14 m/s which is the ejection speed of the ink droplet ejected from the other ejection opening 25*c* constituting the central group. Concretely, a diameter of the ejection opening 25*e* constituting the end group of the sixteen ejection openings as counted from the endmost one to the sixteenth ejection openings is 18 μm, and that of the other ejection opening 25*c* constituting the central group is 22 μm. In such a manner, by reducing the diameter of the ejection opening 25*e* constituting the end group to be smaller than that of the ejection opening 25*c* constituting the central group, an opening effect is obtainable to increase the ejection speed of the ink droplet ejected from the ejection opening 25*e* constituting the end group as high as 20 m/s. The ejection speed of the ink droplet ejected from the ejection opening 25*c* constituting the central group is 14 m/s.

Therefore, when a so-called printing is carried out on a printing medium by continuously ejecting the ink droplet from all the ejection openings while subjecting the print head of such an ink jet system to the scanning motion at a high speed along the printing medium together with the carriage, in the prior art wherein the ejection speeds of the ink droplets from all the ejection openings are equal to each other, a gap of the while streak as shown in FIG. 18 reaches as large as 40 μm. Contrarily, according to this embodiment wherein the ejection speed increases, a time required for the ink droplet ejected from the head reaching the printing medium becomes short, whereby the gap of the white streak is suppressed to 19 μm to make the white streak appearing in the prior art substantially invisible.

In this embodiment, the ejection speed of the ink droplet ejected from the ejection opening 25*e* in the end group constituted by sixteen ejection openings counted from the endmost one of the arrangement increases. However, the number of the ejection openings 25*e* constituting the end group is not limited to that of this embodiment, but may be suitably changed provided it is ¼ or less of a total number of the ejection openings for ejecting one kind of liquid. According to this embodiment, two rows of ejection openings 25 are arranged while shifting those constituting the one row by half a pitch in the arrangement direction to those constituting the other row. However, the same may be applied to the ejection openings 25 formed in one row on the print head. The present invention also may be used for a print head having dummy ejection openings from which no ink droplet is ejected when the image is formed. In this case, the dummy ejection openings must be omitted from the ejection openings 25 counted from the opposite end in the arrangement direction so that the ejection openings 25 actually used for the formation of the image are contained therein.

Third Embodiment

In the second embodiment, a diameter of the ejection opening 25*e* constituting the end group in the opposite end section of the arrangement is larger than that the ejection opening 25*c* constituting the central group in the central section of the arrangement so that the ejection speed of the ink droplet ejected from the ejection opening 25*e* constituting the end group is higher than the ejection speed of the ink droplet ejected from the ejection opening 25*c* constituting the central group. However, it is also possible to increase the heat-generation area of the electro-thermal transducer 30*e* corresponding to the ejection opening 25*e* constituting the end group to be larger than the heat-generation area of the electro-thermal transducer 30*c* corresponding to the ejection opening 25*c* constituting the central group so that the ejection speed, that is, the kinetic energy of the ink droplet becomes larger in the end group than in the central group.

For example, in the print head 19 having the structure of the first embodiment shown in FIG. 4, the drive frequency supplied to the electro-thermal transducer 30 is 10 kHz and the scanning speed of the carriage is 211.7 mm/s so that the dot density in the scanning direction of the carriage becomes 1200 dpi. Thereby, it is possible to eject the ink droplet from one ejection opening 25 at every 67 μs at the shortest.

Figure 10:
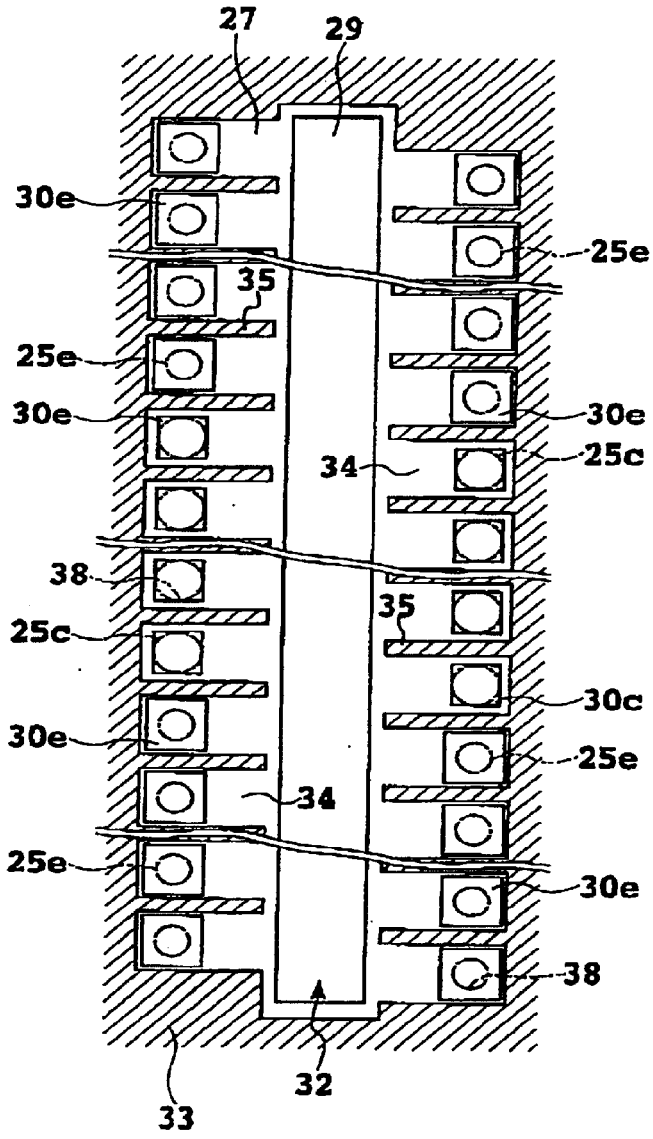
FIG. 10 is a broken plan view illustrating the arrangement of ejection openings and electro-thermal transducers in the print head according to a further embodiment of the present invention.

The arrangement of the ejection openings 25 in the liquid ejection head of the present invention according to a further embodiment is shown in FIG. 10. In this embodiment, the same reference numerals are used for denoting elements having the same functions as in the preceding embodiment, and the duplication of the explanation will be eliminated. In this embodiment, the heat-generation area of the electro-thermal transducer 30*e* corresponding to the ejection opening 25*e* constituting the end group is larger than the heat-generation area of the electro-thermal transducer 30*c* corresponding to the ejection opening 25*c* constituting the central group. Concretely, each of electro-thermal transducers 30*e* corresponding to sixteen ejection openings 24*e* constituting the end group counted from the endmost one located at the respective opposite end of the arrangement has a 26 μm square shape, and each of the remaining electro-thermal transducers 30*c* corresponding to the ejection openings 25*c* in the central group has a 22 μm square shape. Further, in the same manner as in the second embodiment, each of the sixteen ejection openings 25*e* constituting the end group counted from the endmost one located at the respective opposite end of the arrangement has a 26 μm diameter, and each of the remaining ejection openings 25*c* in the central group has a 16 μm diameter. By reducing the diameter of the ejection opening 25*e* constituting the end group to be smaller than that of the ejection opening 25*c* constituting the central group in such a manner, it is possible to concentrate the bubbling power to the ejection opening 25*e* constituting the end group to increase the ejection speed as well as to combine ink droplets ejected from the opposite end section and the central section with each other.

Therefore, the ejection speed of the ink droplet ejected from the ejection opening 25*e* disposed in the opposite end section of the arrangement to constitute the end group becomes 20 m/s, while the ejection speed of the ink droplet ejected from the ejection opening 25*c* disposed in the central section to constitute the central group becomes 14 m/s, which ink droplet having a volume of 4.5 pico-liter by one drive pulse signal forms a dot having a 48 μm diameter, respectively, on the printing medium.

When a so-called printing is carried out on a printing medium, in the prior art print head wherein the electro-thermal transducer 30 has a 24 μm square shape and the ejection opening 25 has a 15.5 μm diameter, a gap of a white streak becomes as large as approximately 60 μm as shown in FIG. 18, while in this embodiment, the distance could be suppressed to 27 μm to make the white streak appearing in the prior art substantially invisible. According to this embodiment, a diameter of the ejection opening 25 is changed between that in the end group and that in the central group. However, even if the ejection openings in the end group and the central group have the same diameter, it is possible to increase the ejection speed of the ink droplet ejected from the ejection opening 25*e* in the end group by enlarging the heat-generation area of the electro-thermal transducer 30*e* corresponding to the ejection opening 25*e* constituting the end group, whereby the same effect is obtainable.

Fourth Embodiment

Figure 11:
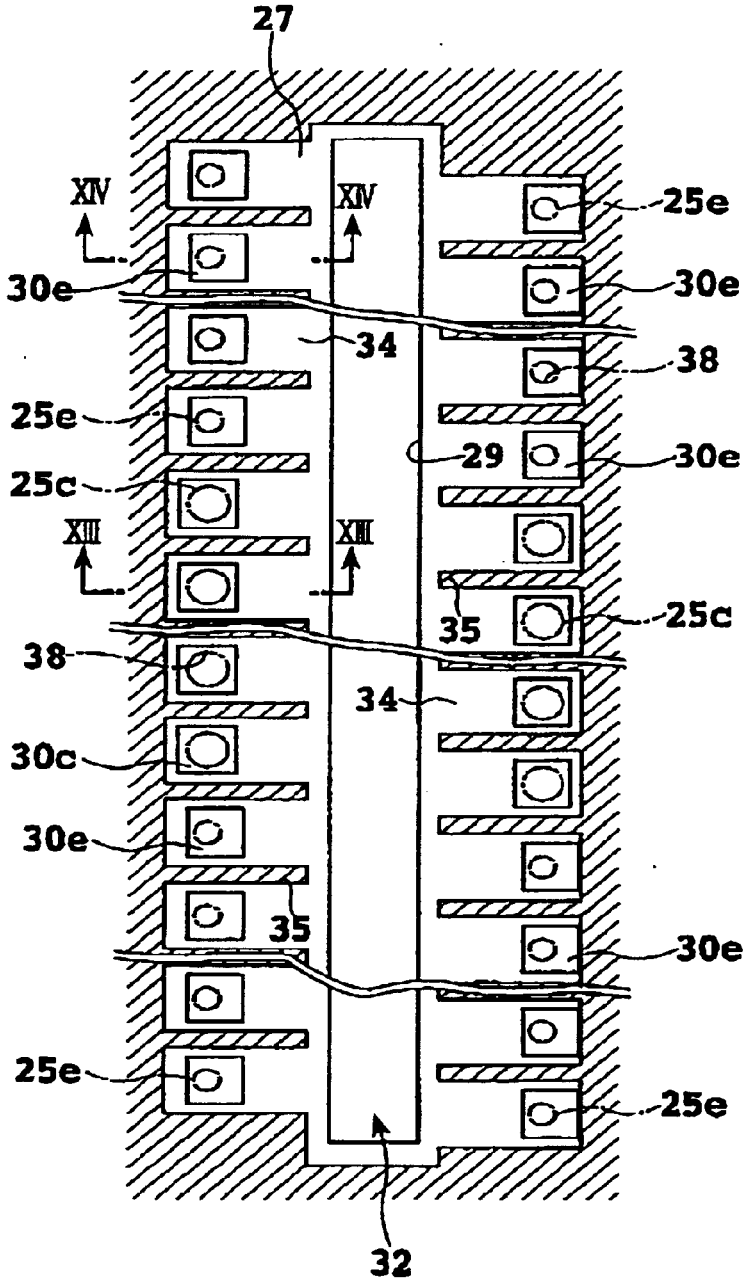
FIG. 11 is a broken plan view illustrating the arrangement of ejection openings and electro-thermal transducers in the print head according to a furthermore embodiment of the present invention.
Figure 12:
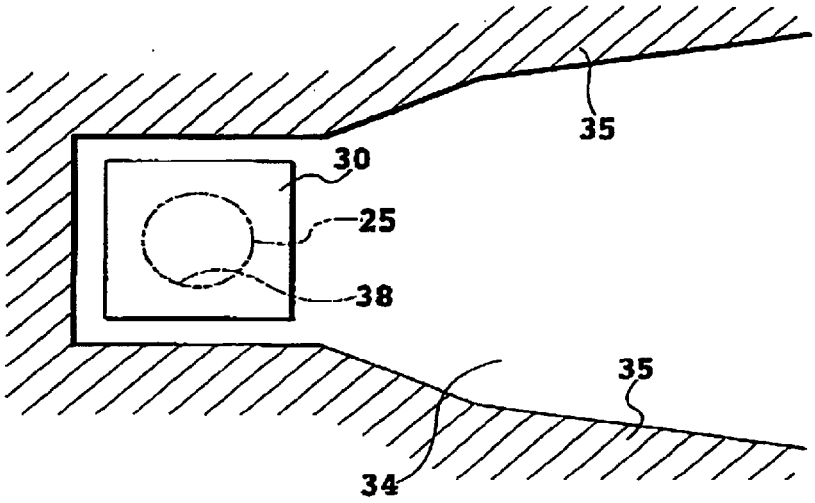
FIG. 12 is a conceptual view of one ejection opening constituting a central group of ejection openings in the embodiment shown in FIG. 11.
Figure 13:
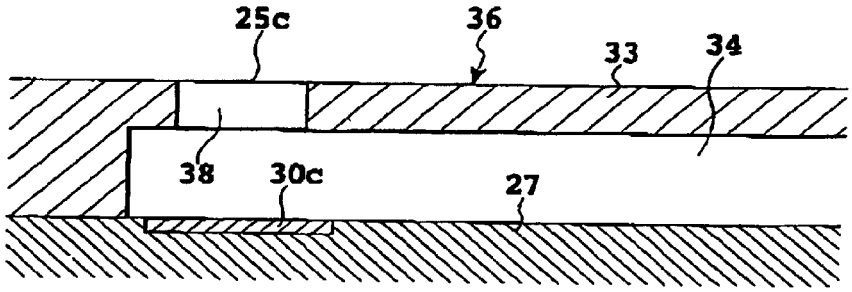
FIG. 13 is a sectional view taken along a line XIII—XIII in FIG. 11, corresponding to an ejection opening disposed in the central section of the arrangement.
Figure 14:
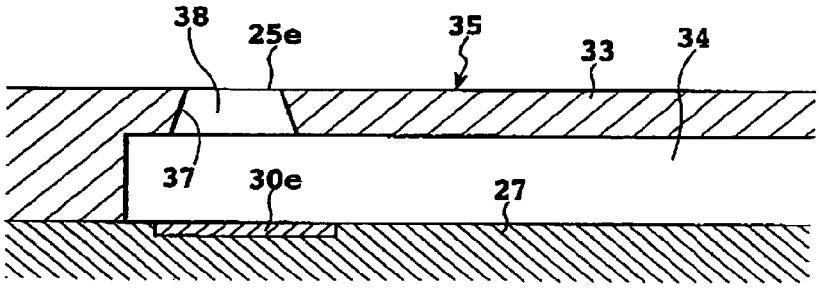
FIG. 14 is a sectional view taken along a line XIV—XIV in FIG. 11, corresponding to an ejection opening disposed in the opposite end section of the arrangement.

When a diameter of the ejection opening 25*e* constituting the end group disposed in the opposite end section of the arrangement is reduced to be smaller than that of the ejection opening 25*c* constituting the central group disposed in the central section of the arrangement, it is possible to taper a nozzle 38 contiguous to the ejection opening 25*e* constituting the end group. Alternatively, it is also possible to taper the nozzle 38 without reducing the diameter of the ejection opening 25*e*. FIG. 11 illustrates in a broken state such an arrangement of the ejection opening 25 and the electro-thermal transducers 30 according to another embodiment of the present invention; FIG. 12 illustrates a planar structure of one ink passage of the ejection opening in the central group; FIG. 13 illustrates a sectional view taken along a line XIII—XIII in FIG. 11; and FIG. 14 illustrates a sectional view taken along a line XIV—XIV in FIG. 11. In this embodiment, the same reference numerals are used for denoting elements having the same functions as in the preceding embodiment, and the duplication of the explanation will be eliminated.

A basic structure of the print head according to the present invention is the same as in the above-mentioned first embodiment. However, each of the electro-thermal transducers 30 has a 18 μm square shape, and each of the sixteen nozzles 38 (as counted from the endmost one disposed at the respective opposite end), having the ejection opening 25*e* disposed in the opposite end section in the arrangement to constitute the end group is formed by a tapered hole 37 having a taper angle of 8 degrees so that the inner diameter is 15.5 μm. On the other hand, each of the remaining ejection openings 25*c* disposed in the central section to constitute the central group has a diameter of 15.5 μm, whereby the ink droplet of 3.8 pico-liter is ejected from the respective ejection opening 25*e*, 25*c*. As a result, the ejection speed of the ink droplet ejected from the ejection opening 25*c* disposed in the central section to constitute the central group becomes 14 m/s, while the ejection speed of the ink droplet-ejected from the ejection opening 25*e* disposed in the end section to constitute the end group reaches as high as 27 m/s, whereby the kinetic energy of the ink droplet increases to a great extent.

In such a manner, if the ejection speed of the ink droplet ejected from the ejection opening 25*e* disposed in the opposite end section to constitute the end group reaches approximately twice that of the ink droplet ejected from the ejection opening 25*c* constituting the central group, the positional deviation in the scanning direction of the carriage of dots formed on the printing medium becomes conspicuous. Therefore, the position of the electro-thermal transducer 30*e* corresponding to the ejection opening 25*e* disposed in the opposite end section to constitute the end group is shifted reverse to the scanning direction of the carriage (leftward in FIG. 11) by 10.2 μm so that the dots formed on the printing medium by the ink droplets are corrected to be linearly arranged on one line when a so-called solid printing is carried out. Alternatively, by shifting the position of the ejection opening 25*e* disposed in the opposite end section in the arrangement to constitute the end group by 10.2 μm in the scanning direction of the carriage, substantially the same effects are obtainable.

Figure 15:
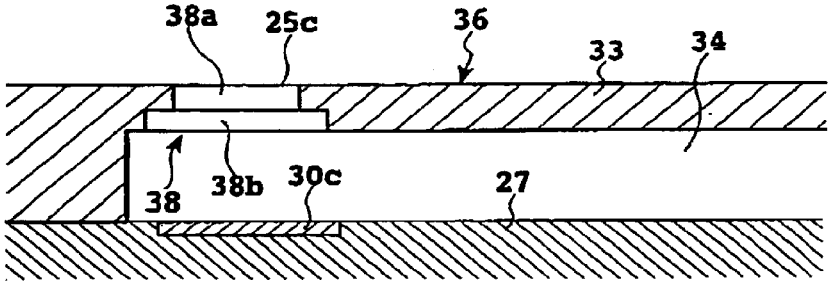
FIG. 15 is a sectional view of one ejection opening constituting the end group in a further embodiment of the liquid ejection head according to the present invention.
Figure 16:
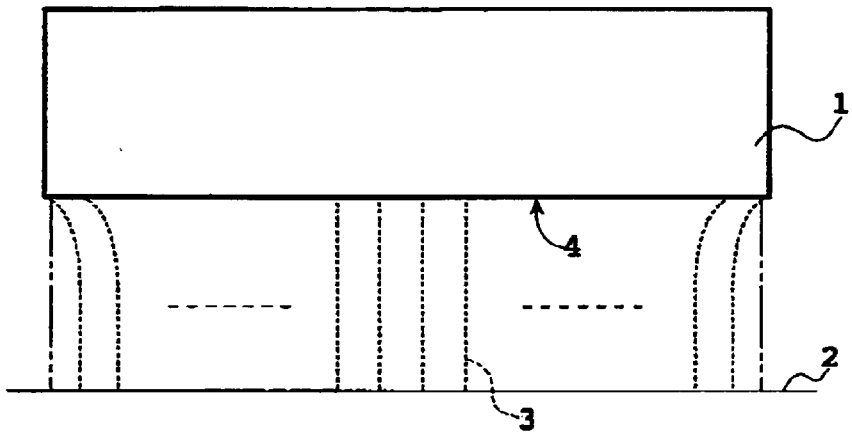
FIG. 16 is a conceptual view schematically illustrating the ejection of ink from the prior art ink jet printer.
Figure 17:
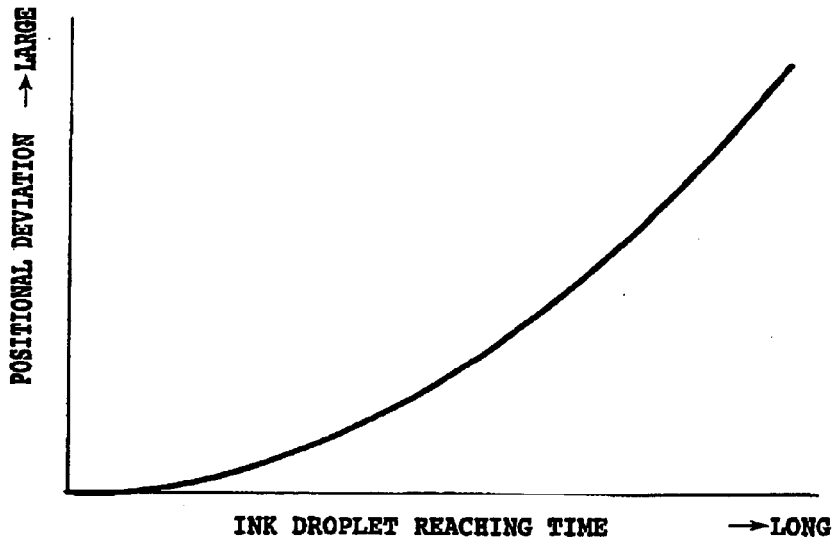
FIG. 17 is a graph representing the relationship between a time in which an ink droplet ejected from the ejection opening disposed in the opposite end section of the arrangement reaches the printing medium and an amount of the positional deviation of the ink droplet on the printing medium.

The comparison was made as follows, between the print head according to this embodiment and the prior art print head wherein the ejection opening constituting the end group and that constituting the central group have the same diameter of 15.5 μm. That is, a so-called solid printing was carried out while setting a distance between the ejection opening surface and the printing medium at 1.3 mm. In the prior art print head, a gap of a white streak as shown in FIG. 17 reaches as large as 63 μm, while in this embodiment, it is suppressed as small as 18 μm to make the white streak appearing in the prior art substantially invisible. It is also possible to adopt a stepped hole having a small diameter section and a large diameter section instead of the nozzle 38 having the tapered hole 37. FIG. 15 illustrates an ejection opening of a nozzle having such a stepped hole constituting the end group similar to FIG. 14. This stepped nozzle 38 has a small diameter section 38*a* with an ejection opening 25*e* at a tip end and a large diameter section 38*b* located at a proximal end while being opposed to an ink passage 34, wherein the inner diameter of the small diameter section 38*a* is 15.5 μm. Even if such a stepped nozzle 38 is adopted, it is possible to accelerate the ejection speed of the ink droplet ejected from the ejection opening 25*e* to 27 m/s, whereby the same effect as in FIG. 15 is achievable.

In such a manner, by forming the nozzle 38 to have the tapered hole 37 or to have the stepped sections so that the viscous drag is reduced, it is possible to accelerate the ejection speed. Similarly, it is possible to form all of the nozzles 38 including the central group by the tapered holes 37 wherein the taper angle of the tapered hole of the nozzle corresponding to the ejection opening constituting the end group is larger than the taper angle of the tapered hole of the nozzle corresponding to the ejection opening constituting the central group, or to form all of the nozzles including the central group by the stepped holes wherein a passage length of the small diameter section (a height of the small diameter section 38*a* in FIG. 15) corresponding to the ejection opening constituting the end group is shorter than a passage length of the small diameter section corresponding to the ejection opening constituting the central group. In either cases, the same effect is obtainable.

Fifth Embodiment

In the above-mentioned fourth embodiment, by shifting the position of the electro-thermal transducer 30 corresponding to the ejection opening disposed in the opposite end section to constitute the end group in reverse to the scanning direction of the carriage, care is taken to linearly arrange dots formed by the ink droplets on the printing medium. However, since this method has a drawback in that the printing operation could not be carried out in a reciprocation manner, it is effective to drive the electro-thermal transducer 30*e* corresponding to the ejection opening 25*e* disposed in the opposite end section in the arrangement to constitute the end group after the electro-thermal transducer 30*c* corresponding to the ejection opening 25*c* disposed in the central section in the arrangement to constitute the central group has been driven; that is, the electro-thermal transducer 30*e* is driven at a final stage of the drive period. In this case, the print head in this embodiment has the same basic structure as in the first embodiment described before, and the electro-thermal transducers 30 are divided into 16 blocks in the arrangement direction for controlling the drive thereof. That is, the drive of the electro-thermal transducers 30*e* in two blocks corresponding to the ejection openings disposed in the opposite end sections of the arrangement constituting the end groups is always carried out after the electro-thermal transducers 30*c* in the remaining 14 blocks corresponding to the ejection openings disposed in the central section of the arrangement constituting the central group has been driven. Also in this embodiment, each of the nozzles 38 contiguous to 16 ejection openings 25*e* counted from the endmost one of the opposite end section constituting the end group has a tapered hole 37 with a taper angle of 8 degrees in the same manner as in the preceding embodiment shown in FIG. 13, so that the ejection speed of the ink droplet ejected from the 16 ejection openings 25*e* constituting the end group is 20 μm/s and the ejection speed of the ink droplet ejected from the remaining ejection openings 25*c* constituting the central group is 14 μm/s. All the electro-thermal transducers 30 have a 23 μm square shape, and the ejection opening 25*c* disposed in the central section in the arrangement to constitute the central group has a diameter of 15.5 μm.

In such a manner, by driving the electro-thermal transducers 30*e* corresponding to the ejection openings in two blocks disposed in the opposite end section always after driving the electro-thermal transducers 30*c* corresponding to the ejection openings in the remaining 14 blocks disposed in the central section during every reciprocation of the carriage to carry out a so-called solid printing on the printing medium, it is possible to suppress a gap of a white streak as shown in FIG. 18 to 27 μm to make the white streak appearing in the prior art as large as approximately 60 μm substantially invisible. In addition, even if the printing operation is carried out both in going and returning paths of the reciprocation of the carriage, it is possible to eliminate the positional deviation of the dot to allow a high-speed printing.

Sixth Embodiment

It has been known that when the heat generating area of the electro-thermal transducer 30 is changed, a width of the drive pulse is also made to vary. For example, assuming that the electro-thermal transducer 30*c* corresponding to the ejection opening disposed in the central section in the arrangement constituting the central group is of a 22 μm square, and the electro-thermal transducer 30*e* corresponding to the ejection opening disposed in the opposite end section in the arrangement constituting the end group is of a 26 μm square, a width of the drive pulse becomes 0.86 μs and 1.20 μs, respectively, when the drive voltage of 11.0 V is applied thereto. It is favorable to equalize all the widths of the drive pulse by increasing a resistance of the wiring for the electro-thermal transducer 30*c* corresponding to the ejection opening disposed in the central section in the arrangement to be larger than that for the electro-thermal transducer 30*e* corresponding to the ejection opening disposed in the opposite end section in the arrangement. In this embodiment, the width of the drive pulse for the electro-thermal transducer 30 is equalized to 1.20 μm for the drive voltage of 11.0 V. Also in this case, a diameter of the ejection opening 25*e* disposed in the opposite end section constituting the end group is 16 μm and that of the ejection opening 25*c* disposed in the central section constituting the central group is 14 μm so that a size of the ink droplet ejected from the ejection opening 25*e* disposed in the opposite end section constituting the end group and that of the ink droplet ejected from the ejection opening 25*c* disposed in the central section constituting the central group are equal to each other. Thereby, it is possible to eject the ink droplet of 4.5 pl from the individual ejection opening 25 in one ejecting operation.

In this embodiment, the drive frequency for the individual electro-thermal transducer 30 is 30 kHz, and the scanning speed of the carriage is 635 mm/s so that the dot density becomes 1200 dpi measured in the scanning direction of the carriage. Accordingly, considering one ejection opening 25, the shortest ejection interval of the ink droplet from this ejection opening 25 is approximately 33 μm, and basically similar to the third embodiment, the kinetic energy of the ink droplet ejected from the ejection opening 25*e* disposed in the opposite end section in the arrangement constituting the end group is larger than that of the ink droplet ejected from the ejection opening 25*c* disposed in the central section in the arrangement constituting the central group. As a result, even if a so-called solid printing is carried out on the printing medium, it is possible to prevent the white streak as shown in FIG. 18 from generating.

The present invention achieves distinct effect when applied to the liquid ejecting head, the head cartridge, or the image printing apparatus which has means for generating thermal energy such as electrothermal transducers or laser beam, and which causes changes in ink by the thermal energy so as to eject liquid. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid, and operates as follows: first, one or more driving signals are applied to the electrothermal transducers to cause thermal energy corresponding to printing information; second, the thermal energy induces sudden temperature rise that exceeds the nucleate boiling so as to cause the film boiling on heating portions of the liquid ejecting head; and third, bubbles are grown in the liquid corresponding to the driving signals. By using the growth and collapse of the bubbles, the ink is expelled from at least one of the ejecting ports of the head to form one or more liquid drops. The driving signal in the form of a pulse is preferable because the growth and collapse of the bubbles can be achieved instantaneously and suitably by this form of driving signal. As the driving signal in the form of a pulse, those described in U.S. Pat. Nos. 4,463,359 and 4,345,262 are preferable.

In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a liquid ejecting head, which is incorporated to the present invention: this structure includes heating portions disposed on bent portions in addition to a combination of the ejecting ports, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejecting ports of the electrothermal transducers, and the latter discloses a structure in which openings for absorbing pressure waves caused by thermal energy are formed corresponding to the ejecting ports. Thus, irrespective of the type of the liquid ejecting head, the present invention can achieve printing positively and effectively.

The present invention can be also applied to a so-called full-line type liquid ejecting head whose length equals the maximum width across a printing medium. Such a liquid ejecting head may consists of a plurality of liquid ejecting heads combined together, or one integrally arranged liquid ejecting head.

In addition, the present invention can be applied to various serial type liquid ejecting heads: a liquid ejecting head fixed to the main assembly of an image printing apparatus; a conveniently replaceable chip type liquid ejecting head which, when loaded on the main assembly of an image printing apparatus, is electrically connected to the main assembly, and is supplied with liquid therefrom; and a cartridge type liquid ejecting head integrally including a liquid reservoir.

It is further preferable to add a recovery system for ejecting liquid from the ejecting head in adequate condition, or a preliminary auxiliary system for a liquid ejecting head as a constituent of the image printing apparatus because they serve to make the effect of the present invention more reliable. Examples of the recovery system are a capping means and a cleaning means for the liquid ejecting head, and a pressure or suction means for the liquid ejecting head. Examples of the preliminary auxiliary system are a preliminary heating means utilizing electrothermal transducers or a combination of other heater elements and the electrothermal transducers, and a means for carrying out preliminary ejection of liquid independently of the ejection for printing. These systems are effective for reliable printing.

The number and type of liquid ejecting heads to be attached on an image printing apparatus can be also detached. For example, only one liquid ejecting head corresponding to a single color ink, or a plurality of liquid ejecting heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing. In this case, the treatment liquid (the printability enhanced liquid) for adjusting the printing state of the ink may also be ejected from each individual heads or a common ejecting head to the printing medium in accordance with a kind of the printing medium or the printing mode.

Furthermore, although the above-described embodiments use liguids, liquids that are liquid when the printing signal is applied can be used: for example, liquids can be employed that solidify at a temperature lower than the room temperature and are softened or liquefied in the room temperature. This is because in the ink jet system, the liquid is generally temperature adjusted in a range of 30° C. to 70° C. so that the viscosity of the liquid is maintained at such a value that the liquid can be ejected reliably. In addition, the present invention can be applied to such apparatus where the liquid is liquefied just before the ejection by the thermal energy as follows so that the liquid is expelled from the ports in the liquid state, and then begins to solidify on hitting the printing medium, thereby preventing the liquid evaporation: the liquid is transformed from solid to liquid state by positively utilizing the thermal energy which would otherwise cause the temperature rise; or the liquid, which is dry when left in air, is liquefied in response to the thermal energy of the printing signal. In such cases, the liquid may be retained in recesses or through holes formed in a porous sheet as liquid or solid substances so that the liquid faces the electrothermal transducers as described in Japanese Patent Application Laying-open Nos. 54-56847 (1979) or 60-71260 (1985). The present invention is most effective when it uses the film boiling phenomenon to expel the liquid.

Furthermore, the image printing apparatus in according to the present invention can be employed not only as an image output terminal of an information processing device such as a computer, but also as an output device of a copying machine combining with a reader or the like, a facsimile apparatus having a transmission and receiving function, or printing press for cloth. A sheet or web paper, a wooden or plastic board, a stone slab, a plate glass, metal sheet, a three dimensional structure or the like may be used as the printing medium in according to the present invention.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A method for ejecting liquid with a relative motion between a liquid ejection head and a printing medium, the liquid ejection head having a plurality of ejection openings arranged in a predetermined direction and a plurality of ejection energy generating elements for ejecting liquid from the ejection openings, wherein a flight speed of the liquid ejected from each ejection opening constituting an end group disposed in respective opposite end sections along the predetermined direction is higher than a flight speed of the liquid ejected from each ejection opening constituting a central group disposed in a central section along the predetermined direction, and wherein the ejection energy generating elements corresponding to the end group are driven at a final stage of a drive period of all the ejection energy generating elements.

2. A method for ejecting liquid as claimed in claim 1, wherein the flight speed of the liquid ejected from each ejection opening constituting the end group is three times or less the flight speed of the liquid ejected from each ejection opening constituting the central group.

3. A method for ejecting liquid as claimed in claim 1, wherein a driving signal supplied to an ejection energy generating element for ejecting the liquid from an ejection opening one time has a plurality of pulse signals, and wherein a first pulse signal length supplied to an ejection energy generating element corresponding to an ejection opening in the end group is longer than a first pulse signal length supplied to an ejection energy generating element corresponding to an ejection opening in the central group.

* * * * *

UNITED STATES PATENT AND TRADEMARK OFFICE

CERTIFICATE OF CORRECTION

PATENT NO. : 6,854,820 B2
DATED : February 15, 2005
INVENTOR(S) : Shuichi Murakami et al.

It is certified that error appears in the above-identified patent and that said Letters Patent is hereby corrected as shown below:

Title page,
Item [57], ABSTRACT,
Line 1, “an” should read -- a --.

Column 1,
Line 16, “a” should be deleted.
Line 28, “refers” should read -- and refers --.
Line 36, “an” should be deleted.
Line 65, “picoliter” should read -- picoliters --.

Column 2,
Line 9, “as” should be deleted.
Line 21, “a” should be deleted.

Column 3,
Line 16, “proportional” should read -- proportion --.
Line 30, “pico-liter” should read -- picoliters --.

Column 8,
Line 14, “hard to be suffered” should read -- does not easily suffer --.

Column 9
Lines 46, 47 and 52, “pico-liter.” should read -- picoliters. --.

Column 11,
Line 5, “claim” should read -- the claims --.

Column 13,
Line 28, “pico-liter” should read -- picoliters --.

Column 14,
Line 40, “openine” should read -- opening --.

Column 15,
Line 22, “while” should read -- white --.

Column 16,
Line 43, “pico-liter” should read -- picoliters --.

UNITED STATES PATENT AND TRADEMARK OFFICE

CERTIFICATE OF CORRECTION

PATENT NO. : 6,854,820 B2
DATED : February 15, 2005
INVENTOR(S) : Shuichi Murakami et al.

It is certified that error appears in the above-identified patent and that said Letters Patent is hereby corrected as shown below:

Column 17,
Line 30, "pico-liter" should read -- picoliters --.

Column 18,
Line 61, "has" should read -- have --.

Column 21,
Line 35, "a" should be deleted, and "the" (both occurrences) should be deleted.

Column 22,
Line 5, "in" should be deleted.

Signed and Sealed this

Twenty-eighth Day of March, 2006

JON W. DUDAS
*Director of the United States Patent and Trademark Office*